United States Patent [19]

Braun et al.

[11] Patent Number: 4,580,220

[45] Date of Patent: Apr. 1, 1986

[54] FAILSAFE EMERGENCY OPERATION DEVICE FOR IDLING OPERATION IN MOTOR VEHICLES

[75] Inventors: Günter Braun, Freiberg; Wolfgang Kosak, Möglingen; Alfred Kratt, Trossingen, all of Fed. Rep. of Germany

[73] Assignee: Robert Bosch GmbH, Stuttgart, Fed. Rep. of Germany

[21] Appl. No.: 515,843

[22] Filed: Jul. 21, 1983

[30] Foreign Application Priority Data

Jul. 23, 1982 [DE] Fed. Rep. of Germany ..... 3227546
Jun. 21, 1983 [DE] Fed. Rep. of Germany ..... 3322240

[51] Int. Cl.[4] ..... F02D 11/10

[52] U.S. Cl. ..... 364/431.11; 123/339; 123/479

[58] Field of Search ..... 364/431.11; 123/339, 123/585, 479; 371/9

[56] References Cited

U.S. PATENT DOCUMENTS 4,328,547 5/1982 Barman et al. ..... 123/480
4,370,962 2/1983 Hosaka ..... 123/479
4,386,427 5/1983 Hosaka ..... 364/431.11
4,441,471 4/1984 Kratt et al. ..... 123/339
4,487,186 12/1984 Wahl et al. ..... 123/585

FOREIGN PATENT DOCUMENTS 2128779 5/1984 United Kingdom ..... 123/339

*Primary Examiner*—Parshotam S. Lall
*Attorney, Agent, or Firm*—Edwin E. Greigg

[57] ABSTRACT

A failsafe emergency operation device for the idling operation of motor vehicles, in particular for a digital idling charge regulation having a final control element triggered by an end stage circuit, which final control element, as a two-coil rotary adjuster, controls the cross section of an air bypass parallel to the throttle valve. A central computer (microprocessor, microcomputer) prepares a digital trigger signal for the end stage having a duty cycle which is variable depending upon the final control element position required. At the same time, at at least one position of the final control element, an end stage monitoring signal which is to be fed back is prepared and fed back to the computer, which via a separate shutoff stage for the end stage makes this end stage current-free whenever agreement does not exist between the two signals in terms of the duty cycle. A failsafe circuit is furthermore provided, which receives separate control pulses or is supplied with the duty cycle trigger signal supplied to the end stage by the computer, and in case of malfunction this failsafe circuit emits a reset signal, which likewise shuts off the end stage, resets the microcomputer, or alternatively can throw an emergency operation generator ON, which generator then supplies the end stage with an emergency operation duty cycle for triggering it.

20 Claims, 19 Drawing Figures

FAILSAFE EMERGENCY OPERATION DEVICE FOR IDLING OPERATION IN MOTOR VEHICLES

BACKGROUND OF THE INVENTION

The invention relates to a failsafe emergency operation device for idling operation in motor vehicles, in particular for a digital idling charge regulation means. The device includes a final control element (two-coil rotary adjuster) which acts as an air bypass parallel to the throttle valve and is triggered by an end stage circuit.

For controlling electrical or electromechanical equipment or for controlling system functions, it is known to use microprocessors or microcomputers which derive control signals for the actuation of final control elements from one or more operating parameters of the system. Such devices are used in motor vehicles, for instance to operate injection systems, ignition systems, transmission controls or an idling charge regulating means, either separately or combined in a central logic block. In this context, it is also known to provide monitoring devices, which monitor the proper operation of the equipment and emit an alarm signal and/or effect emergency control if a malfunction occurs.

SAE Technical Paper No. 810157 describes a microcomputer-controlled means of regulating an internal combustion engine. The microcomputer or microprocessor used there generates control pulses which are built into its control program; these pulses are completed by the microprocessor and therefore appear at regular intervals when the equipment is functioning properly. A malfunction in the program or on the part of the device can then be detected by a memory circuit or some other device, since in this case—for instance if the computer shuts down—no further control pulses are emitted. In the monitoring circuit according to this SAE Paper, a monostable multivibrator is provided, the output of which can be supplied to the injection system and the ignition device. Below a prescribed engine speed, the regular control pulses are suppressed; this is the case particularly when the engine is started.

A reset circuit for a microcomputer is also known from German Offenlegungsschrift No. 30 35 896, in which the control pulses indirectly effect the charging or discharging of a capacitor, so that the absence of the control pulses can be recognized by monitoring the capacitor voltage. If changes beyond a predetermined extent occur in the sequence of the control pulses, then the monitoring circuit generates a reset signal which resets the microcomputer. The reset phase is then followed by an unblocking phase, in which the system can start up once again.

Problems can arise in the known devices for monitoring system functions whenever a function has to be monitored which is critical to safety in the event of an undefined malfunction; an example, with an idling charge regulating means, would be the possibility that a two-coil rotary adjuster used for this type of regulation might assume a position corresponding to an undesirable acceleration.

The need therefore exists for a monitoring circuit for use with an idling charge regulating means, which is capable of assuring that in the case of some malfunction the idling charge regulating means will behave in a clearly defined manner and without critically affecting safety.

OBJECT AND SUMMARY OF THE INVENTION

The failsafe emergency operation device according to the invention has the advantage over the prior art that because the end stage which triggers the final control element is triggered digitally, it is possible to attain satisfactory recognition of errors by feeding back the end stage output signals to the triggering computer, which in turn then generates a shutoff signal and delivers it to a separate shutoff stage for the end stage in such a manner that the end stage as a whole has no electric current flowing through it. The shutoff of the end stage is always effected whenever defects in components arise, for instance caused by alloyed end stage transistors, wire breakage at the two-coil rotary adjuster, errors in transmitting the engine temperature through the NTC line and the like. The existing correction spring in this case establishes a non-critical bypass cross section for the idling charge regulation, preventing an undesired acceleration.

In the case of internal or external malfunctions or interference, which may also persist for a relatively long time, the end stage is shut off in a pulsed manner via a separate failsafe circuit having a minimum duty cycle, thus also providing an emergency function in the event of computer failure.

The invention takes appropriate account of errors in the linearity of the adjuster cross section, caused by the correction spring or by changes in the battery voltage, by providing that the safety circuit enables corrections by interrogating a memory in the case of microcomputers. In the same manner, the microcomputer is designed such that an interruption or non-connection of the NTC resistor supplying engine temperature data to the computer is recognized, and in case of malfunction the end stage is shut off; in like manner, an interruption in the ignition signals is recognized and in case of malfunction the end stage is shut off.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
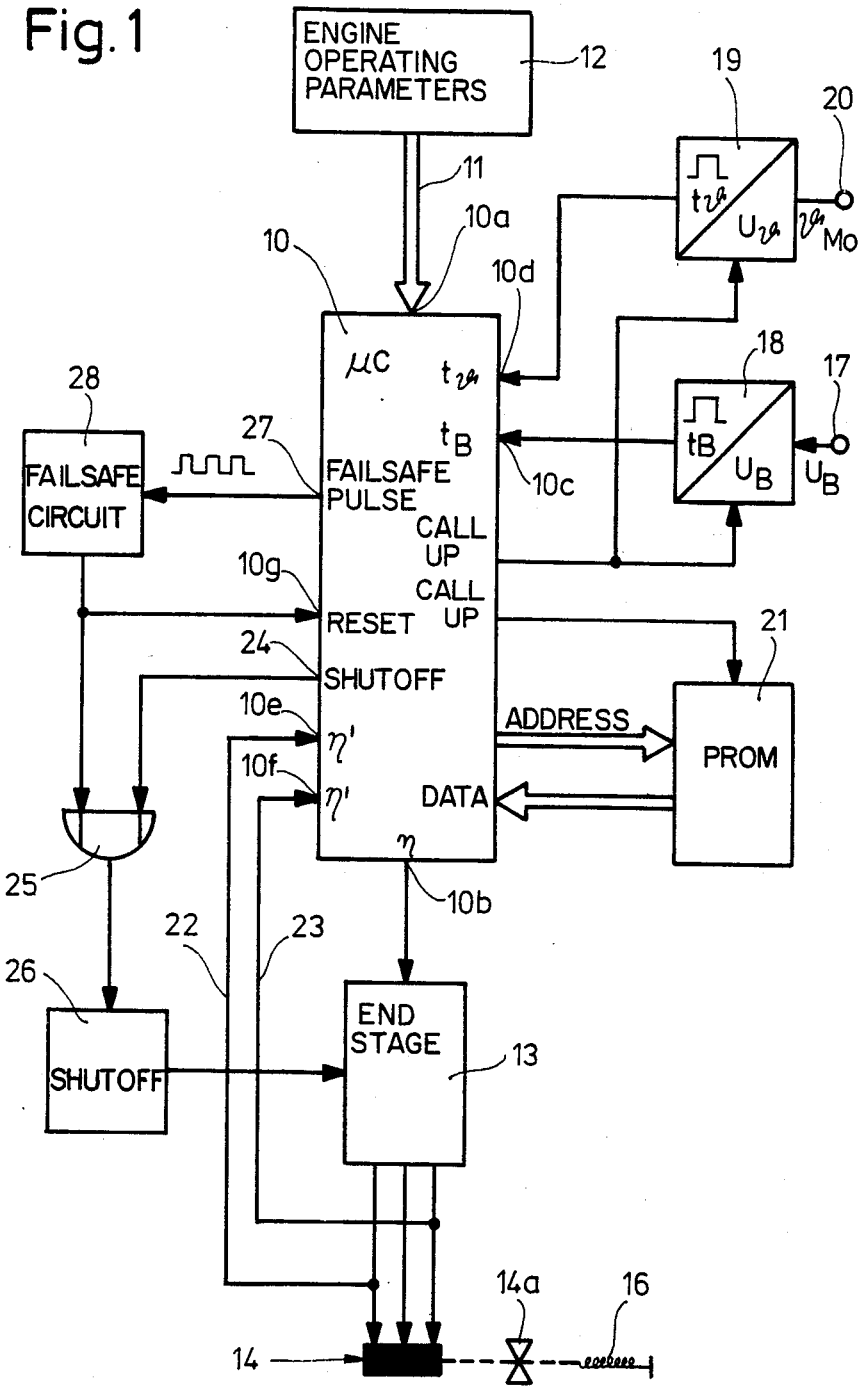
FIG. 1 is a block circuit diagram for the safety circuit having an external failsafe circuit.

In the block circuit diagram of FIG. 1, a microcomputer or microprocessor 10 is shown, the purpose of which is to control certain system fucntions, for instance that of idling charge regulation in a motor vehicle. Associated with the microcomputer 10 are the peripheral component groups provided for the safety of the system and for assuring the required reaction in case of malfunction. In the specialized application represented by the present invention, which relates to a means of idling charge regulation and to which application the following description is specifically directed, signals to be processed are delivered to the microcomputer 10 at its input 10*a* via a data line 11 from a block merely shown schematically at 12; these signals depend on the operating parameters of the system to be controlled or monitored. In the selected application of idling charge regulation, these operating parameters may be data by way of example relating to the actual value of the instantaneous engine speed of the vehicle, the set-point value at that instant, climatic conditions such as pressure and outside temperature, the position of the throttle valve, and the like.

From these data, which also include other information to be explained directly below, the microcomputer 10 prepares a control signal train at its signal output 10*b*, which control signal train serves via an end stage 13 to trigger final control elements, in the present instance a so-called two-coil rotary adjuster 14, which in the case of the idling charge regulation is incorporated as an air bypass parallel to the throttle valve and has a spool 14*a*, the position of which determines a desirable flow-through cross section of the air bypass and is itself the product of the manner in which clocked signals are delivered to the two partial coils 15*a*, 15*b* (see FIG. 2) of the two-coil rotary adjuster 14 via the end stage 13. The final control element, or in the present example the spool 14*a* of the two-coil rotary adjuster 14, is also engaged by a pre-stressing spring 16. In case of a malfunction, this spring 16 mitigates and precludes any dangerous driving situations which might possibly arise if a malfunction results in the non-triggering of the two-coil rotary adjuster, especially while maneuvering or while coasting, by assuring that in that case a bypass cross section with a minimum opening required for driving safety will be established mechanically.

Since the two-coil rotary adjuster is triggered by the microcomputer 10 via the end stage 13 by means of a single digital control pulse train, conventionally a rectangular pulse train, it is the duty cycle of the trigger pulse train which determines the position of the spool 14*a* of the two-coil rotary adjuster; the distribution of the individual pulses is performed by the end stage 13 in a push-pull manner.

Since the prestressing spring 16 continuously urges the two-coil rotary adjuster 14 back into the safety position, then the displacement-dependent spring characteristic curve imparts both a nonlinear course and a battery-voltage dependency to the final control element, because a partial compensation can be attained for the continuously exerted spring pressure $F_A$ by means of the the appropriate design of the partial coil 15*a*, 15*b*.

Thus, with a constant triggering duty cycle as a standard for the bypass cross section $d_s$, the following function results:

$$d_s = f(U_{BATT}, F_A)$$

The conception of safety in the present invention includes the provision that these additional dependencies be compensated for and that incorrect settings be precluded thereby.

A battery voltage signal $U_{BATT}$ is therefore supplied at a connection point 17 to the computer 10, and it is converted into a time duration signal $t_B$ via an interposed analog/digital converter 18 and supplied to the input 10*c* of the computer. In the same manner, a temperature signal of the motor $\nu_{Mot}$, which is a standard for the idling charge regulation, also travels via the analog/digital converter block 19 from the connection 20 to the computer input 10*d*, having been reconverted by the converter circuit 19 into an appropriate, temperature-specific time duration signal $t\nu$. A preferred form of embodiment of a converter for blocks 18 and 19 will be discussed in greater detail below in conjunction with FIG. 3.

The temperature and battery voltage signals may also, however, be entered into the computer by means of external (or internal) A/D converters.

In normal operation, the microcomputer 10, which is preferably designed in the manner of a PID regulator, ascertains the required basic duty cycle $\eta$ from the input parameters and corrects it for the battery voltage influence and the stored spring force influence (nonlinear characteristic curve) by calling up an external data store, which is identified as 21 in the block circuit diagram of FIG. 1 and may be a PROM, EPROM or the like; the flow of data from the data store 21, following appropriate addressing by means of the computer 10, is represented by the arrows indicating multiple lines.

The circuit is completed by a so-called in-computer first control and safety function, which is based on the fact that corresponding inputs 10*e* and 10*f* of the computer are supplied via feedback lines 22, 23 with the adjusting signals for the two end stage portions each of which is responsible respectively for one of the two coil portions of the two-coil rotary adjuster, so that if the fed-back, actual duty cycle $\eta'$ of the coils of the two-coil rotary adjuster deviates from the duty cycle $\eta$, prespecified by the computer itself, then the computer can deliver a shutoff signal from its output 24 via an interposed OR element 25 to a shutoff block 26 shutting off the end stage. Since the computer furthermore emits so-called failsafe pulses or control pulses at its output 27, the appearance of which assures proper operation of the computer, then the safety conception according to the invention can be further augmented by an additionally provided, external safety or so-called failsafe circuit 28 which likewise in case of malfunction supplies a shutoff signal to the shutoff block 26 via the same OR element 25. This shutoff signal simultaneously serves as a reset signal for the microcomputer 10 and is therefore supplied to the input 10*g* thereof.

Figure 2:
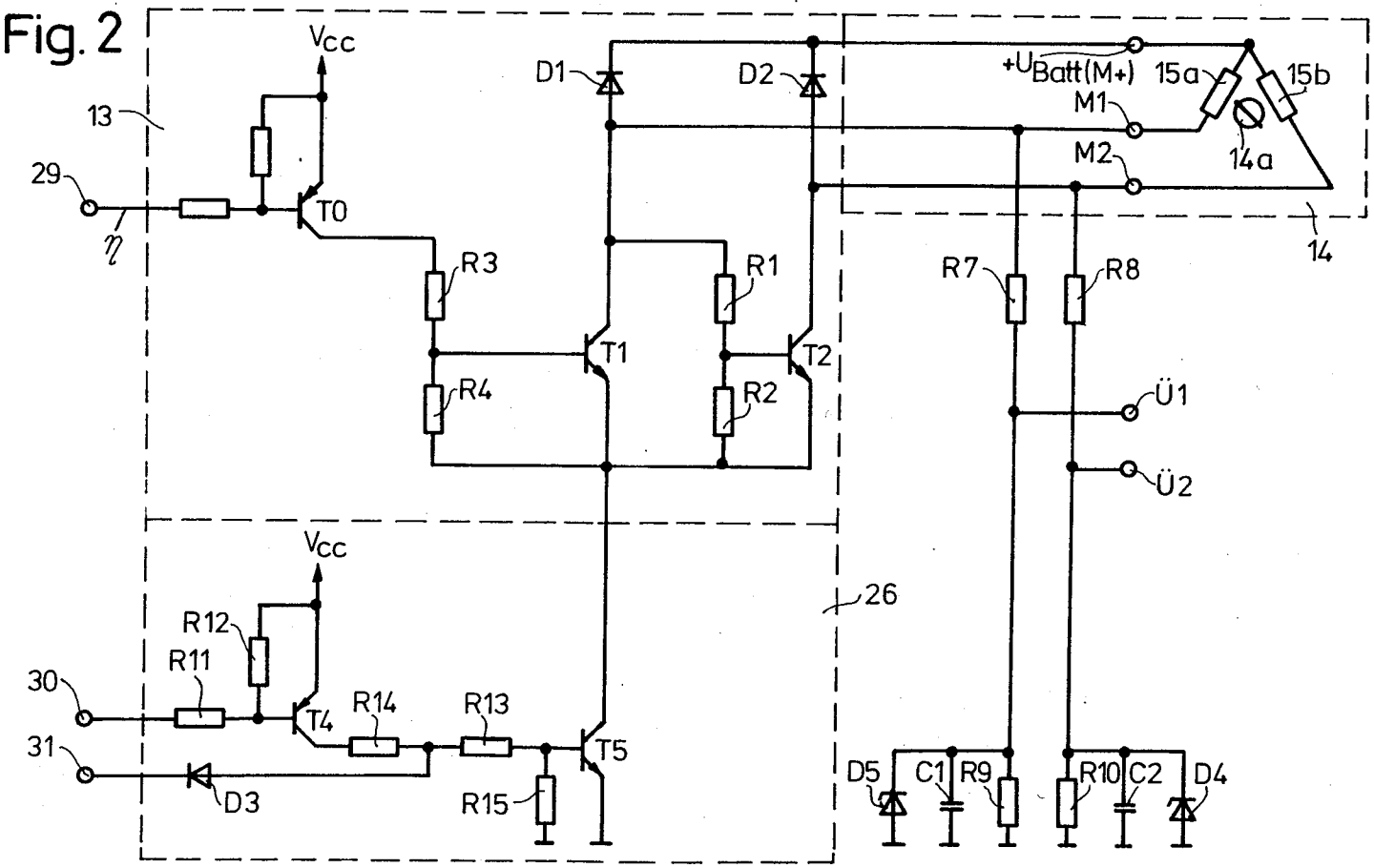
FIG. 2 shows a first detailed exemplary embodiment of the end stage area with its associated shutoff stage.

In the more detailed illustration provided by FIG. 2, which encompasses the end stage 13, the shutoff block 26 and the OR element 25, it can be seen that the end stage 13 includes two end stage semiconductor switches, namely the switching transistors T1 and T2; the collector of T1 is connected via the connection point M1 with the first coil portion 15*a*, and the collector of the switching transistor T2 is connected via the connection point M2 with the second coil portion 15*b* of the two-coil rotary adjuster 14. The two collectors are then connected, via respective diodes D1 and D2 having polarity in the blocking direction, with a positive battery voltage U+, with which the two joined connections of the coil portions 15*a*, 15*b* are also connected (a connection point M+). The two switching transistors T1 and T2 of the end stage 13 are triggered by a preceding driver transistor T0, to which the trigger pulse train having the duty cycle $\eta$ is supplied from the output 10*b* of the microcomputer 10 at the connection point 29. The trigger pulse train travels from the driver transistor T0 to the first switching transistor T1 via the voltage divider R3, R4, whereby the collector of transistor T1 then, via the voltage divider resistors R1, R2, triggers the second switching transistor T2 which follows it. In accordance with the duty cycle of the trigger pulse train, the two end stage transistors T1 and T2 act in alternation in a push-pull manner upon the coil portions, whereupon the relative position of the spool 14*a* at the two-coil rotary adjuster is a product of the various relative durations of the pulses (current time values) supplied to the corresponding coil portions.

The updated switching states at the two-coil rotary adjuster 14 are monitored by detecting the trigger signals at the switching points M1 and M2 leading to the coil portions 15*a*, 15*b* and they travel via resistors R7, R8 having correspondingly associated pulse-former stages, comprising respective parallel-connected diodes D5, D4, capacitors C1 and C2 and resistors R9, R10, in the form of adjuster signals U1 and U2, indicating the updated or actual duty cycle $\eta'$, to the inputs 10*e*, 10*f* of the microcomputer 10.

Shutoff is effected via the shutoff stage 26, which includes a longitudinal transistor T5 with its emitter connected to ground, the collector of which is connected with the two joined emitters of the switching transistors T1 and T2 of the end stage 13. The triggering of the longitudinal transistor T5, which can also cause the end stage 13 to be without current depending upon whether this transistor T5 is conductive or is blocking, is effected via a preceding, further transistor T4, to the input connection 30 of which the shutoff signal from output 24 of the microcomputer 10 is supplied. The OR operation with the reset signal of the safety circuit 28 applied to the other input connection 31 is effected in that the reset signal is supplied via a diode D3 at the junction of two resistors R14, R13 in the trigger loop between the pre-stage transistor T4 and the base of the longitudinal transistor T5, so that a reset signal returning to zero or ground potential blocks the longitudinal transistor T5 and as a result switches the end stage 13 so that it is free of current. In the same manner, a shutoff function for the end stage 13 is produced with a high shutoff signal, or one moving toward a high level, at the input 30, as a result of which the pre-stage transistor T4 blocks and therefore removes the positive potential applied to its collector, causing the longitudinal transistor T5 to enter the blocking state. In the following discussion, the terms "high" and "low", which have been found practical and have become established in the field of electronics for describing potential distributions, will be used consistently, for the sake of simplification, in describing an agreed-upon relatively high potential and a low or ground potential, respectively.

Figure 4:
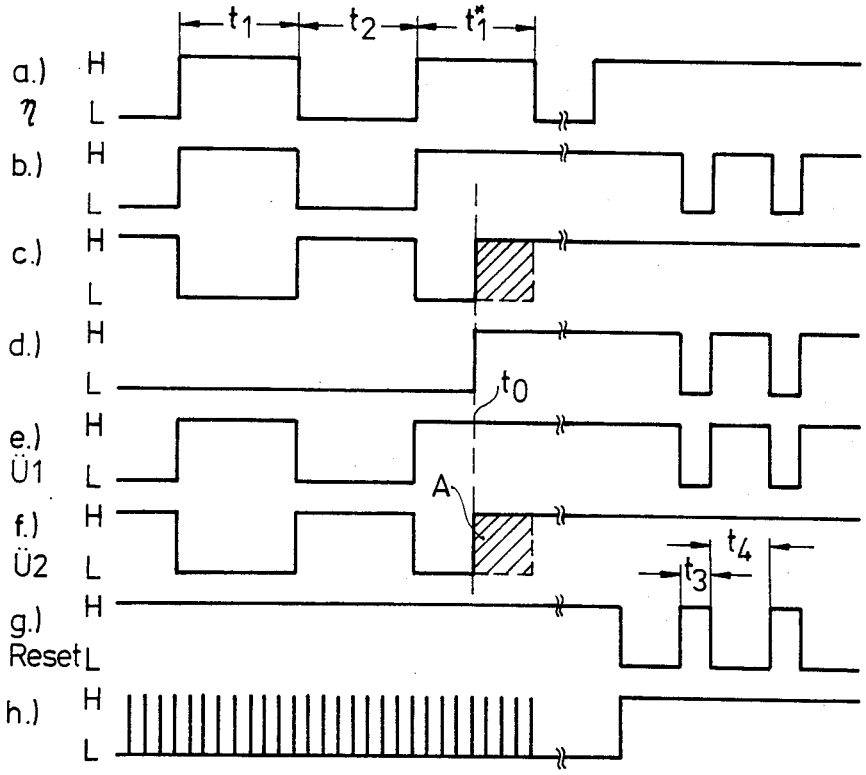
FIGS. 4*a*–4*h* show signal courses at various points of the circuit of FIG. 2.

Referring to the signal courses illustrated in FIG. 4 for various points of the circuitry, the function of the shutoff in both cases (that is, via the microcomputer 10 or via the failsafe circuit 28) can now be explained.

In FIG. 4, (*a*) shows the trigger signal course having the duty cycle $\eta$; the times $t_1$ and $t_2$ can vary relatively in accordance with $\eta$. At (*b*) and (*c*), the signal courses at the switching points M1 and M2 corresponding to the collectors of T1 and T2 are shown. The signal course at (*d*) represents the shutoff signal produced by the microcomputer 10 itself. The signal courses at (*e*) and (*f*) represent the fed-back adjuster signals U1 and U2, respectively, having the updated or actual duty cycle $\eta'$. The signal course at (*g*) indicates the reset signal, which derives from the failsafe circuit, and at (*h*) the failsafe or control pulses produced by the microcomputer 10 are shown; these pulses are supplied to the failsafe circuit 28.

It can be seen that up to the interruption shown, the signal courses characterize an emergency case detected by the microcomputer 10 itself, while following the interruption the failsafe circuit is in operation.

The computer 10 monitors whether the entered signals U1, U2 during the times $t_1$ and $t_2$ correspond to the required signal course having the duty cycle $\eta$.

As soon as an inadmissible status appears, for instance if the transistor T1 is persistently conductive, if there is a short circuit between the collector and emitter of one of the transistors, or if there is a wire break at M1 or M2 causing U1 or U2 to be persistently low or persistently high, then this is recognized by the computer (for example, see the error in the adjuster signal U2 indicated at A in course (f) of FIG. 4, where the signal U2 has gone to high prior to the elapse of the period $t_1$). The computer then shuts off the end stage 13 via the shutoff stage 26, either directly or after performing a time averaging, depending upon how the computer is programmed; in the latter case, the time is averaged over from three to five period durations, for example. The shutoff signal accordingly goes to high at time $t_0$, as shown in (d), thus making the switching transistors T1 and T2 current-free, so that their collectors assume high signals as shown in (b) and (c). This high signal travels via the coil portions 15*a*, 15*b* from the switching point M+ to the collectors. This shutoff by the computer can be rescinded only by turning off the engine and restarting it.

On the other hand, the failsafe circuit 28 serves the purpose of compensating for internal and external interference, as well as in the computer itself, or in the case of a voltage intervention. In the case of interference or malfunction, the failsafe pulses supplied to the failsafe circuit 28 by the computer are absent, as indicated at h in FIG. 4, so that the failsafe circuit 28, with its reset signal returning to low as in (g) via the OR circuit 25 to the longitudinal transistor T5, shuts off the end stage and simultaneously assures a hardware-reset of the computer. For example, the output signal of block 28 is dependent solely and entirely on its input signal, present on the line 27. If this input signal is a pulse train of specific frequency, then no error is present. If this is not the case, however, then the block 28 generates an error signal which triggers both the computer 10, via the line 10*g*, and the end stage 13 via the OR element 25 and the block 26. Based on this error signal, the computer 10 is then reset and the end stage 13 is shut off.

The failsafe circuit here is designed such that in the case of malfunction, it functions as a freely-oscillating oscillator itself; for this purpose it includes at least one capacitor which is continuously charged with the control pulses of the microcomputer 10, so that an input signal picked up via this capacitor travels to one input of a threshold-valve comparator circuit, and if the control pulses are absent this input signal effects a switchover of the comparator output, corresponding to low potential of the reset signal with a subsequent unblocking signal of short duration, by means of feeding back the output to the input. Thus the failsafe circuit in general functions after the manner of a monostable multivibrator; in FIG. 4, curve (g), the unblocking period is indicated a $t_3$ and the reset period as $t_4$.

Since during this unblocking period $t_3$ one or the other of the coils 15*a*, 15*b* of the two-coil rotary adjuster is carrying current, depending upon the status of the duty cycle trigger signal applied to the end stage, the result is that influence is exerted upon the bypass cross section established by means of the spring 16. The duty cycle of the reset signal should therefore be preferably below 5% in the event of a real malfunction.

A further possible source of malfunction may be the additional dependencies of the bypass cross section established by the two-coil rotary adjuster upon the battery voltage, the spring characteristic curve and the engine temperature. Let it be assumed at first that the time signals supplied to the microcomputer 10 at its inputs 10*c*, 10*d* in accordance with the conversion are within conventional limits. In that case, the computer performs appropriate corrections or additions to the duty cycle setting by calling up the data store 21.

Figure 3:
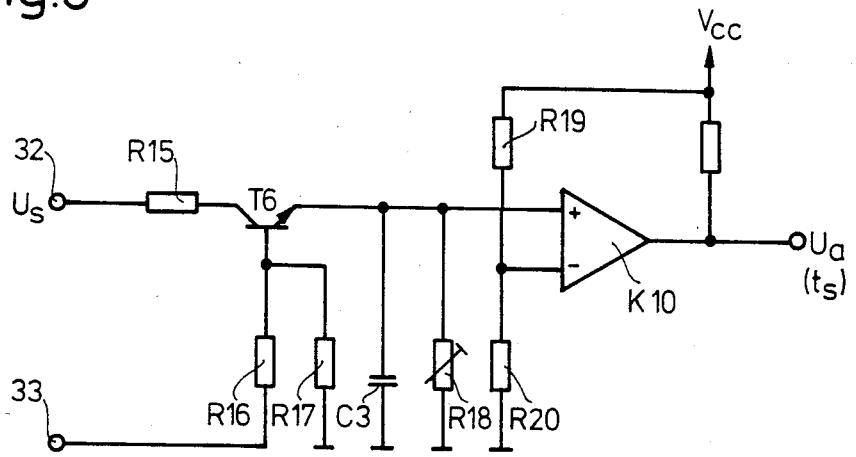
FIG. 3 shows in detail a converter for converting voltage signals into a duration signal evaluatable by the computer.

One form of embodiment of a converter to which an input voltage $U_s$ is supplied, which may be the battery voltage or a voltage proportional to the engine temperature and which is to be converted into a time period, will now be explained, referring first to what is shown in FIG. 3. In FIG. 3, the connection point having the voltage to be converted is identified as 32; this voltage travels via the transistor T6, which if the call-up signal is absent is switched by the microcomputer at input 33 so that it is conductive to a capacitive C3. This capacitor is continuously charged to the voltage $U_s$ which is to be converted. If the call-up pulse appears at the connection 33 of the computer, then the transistor T6 is blocked, and the capacitor C3 discharges via a circuit which is at first shown in the form of an adjustable resistor R18, until its voltage falls below the reference voltage applied by the resistors R19, R20 to a subsequent comparator K1. The comparator K1 at this instant changes its output signal $U_a$, for instance from high to low, and supplies this signal to the computer. The computer is embodied such that it counts out the duration from the setting of the call-up pulse up until the appearance of the comparator, resulting in a proportionality between the ascertained time $t_s$ and the voltage $U_s$. If a linear relationship between these two variables should be desired—in case the computer cannot or should not compensate for a nonlinear relationship by the appropriate call-up of the store 21—then the discharging of the capacitor C3 can also be effected via a constant-current source.

A further important instance of malfunction is an interruption in the line supplying the temperature signal, for instance from an NTC resistor in the vicinity of the engine, to the converter 19. During normal operation, the computer in this case, because of its warmup program, increases the bypass cross section to a correspondingly great extent, so that it is likewise possible that an rpm increase may take place. On the other hand, during normal operation the resistance range of the NTC resistor, used here by way of example for temperature measurement, extends only within prespecified limits (in the preferred exemplary embodiment, this range is between approximately 26 kilo ohms, which corresponds to a maximum voltage applied to the converter 19 and a maximum time period $t_s$ ascertainable by the computer, at approximately −30° C., and less then 400 ohm, which then corresponds to the minimum voltage and the minimum duration pulse, at approximately +80° C. Since an NTC resistance value of infinity is established if there is an interruption in the line or a non-connection, the computer 10 is provided with an instruction to recognize this irregular case, the result being that the computer sets a value which is not critical for the engine temperature, doing so either immediately or after averaging over from two to five call-up periods. This non-critical value may for example correspond to room temperature, +20° C., or to a regulated vlaue of +80° C. Then as soon as regular call-up pulses (that is, those within the theoretically expected range of a time duration signal $t_s$) appear, the computer gives up performing this safety function.

A further significant malfunction is an interruption of the ignition signal, because in that case the actual rpm value $n_{act}$ supplied to the microcomputer 10 is substantially smaller than a set-point rpm value $n_{ref}$. The computer is accordingly provided in this case with a simulated $n_{act} << n_{ref}$, and in order to prevent engine stalling the computer directs the bypass to be fully open, with the possible result that the engine speed may attain a dangerously excessive rpm level.

This malfunction is taken care of by the computer by means of a supplementary software routine, such that within the range of $n_{act} \leqq N_{ref} - 1000$ rpm, the computer will recognize the absence of ignition pulses and will react by shutting off the end stage after the absence of from two to five ignition pulses, depending upon requirements. Once new ignition pulses arrive, however, this shutoff can be rescinded again at an appropriate rpm level, if the line leading from terminal 1 of the engine is provided with a variable-connection contact.

Figure 5:
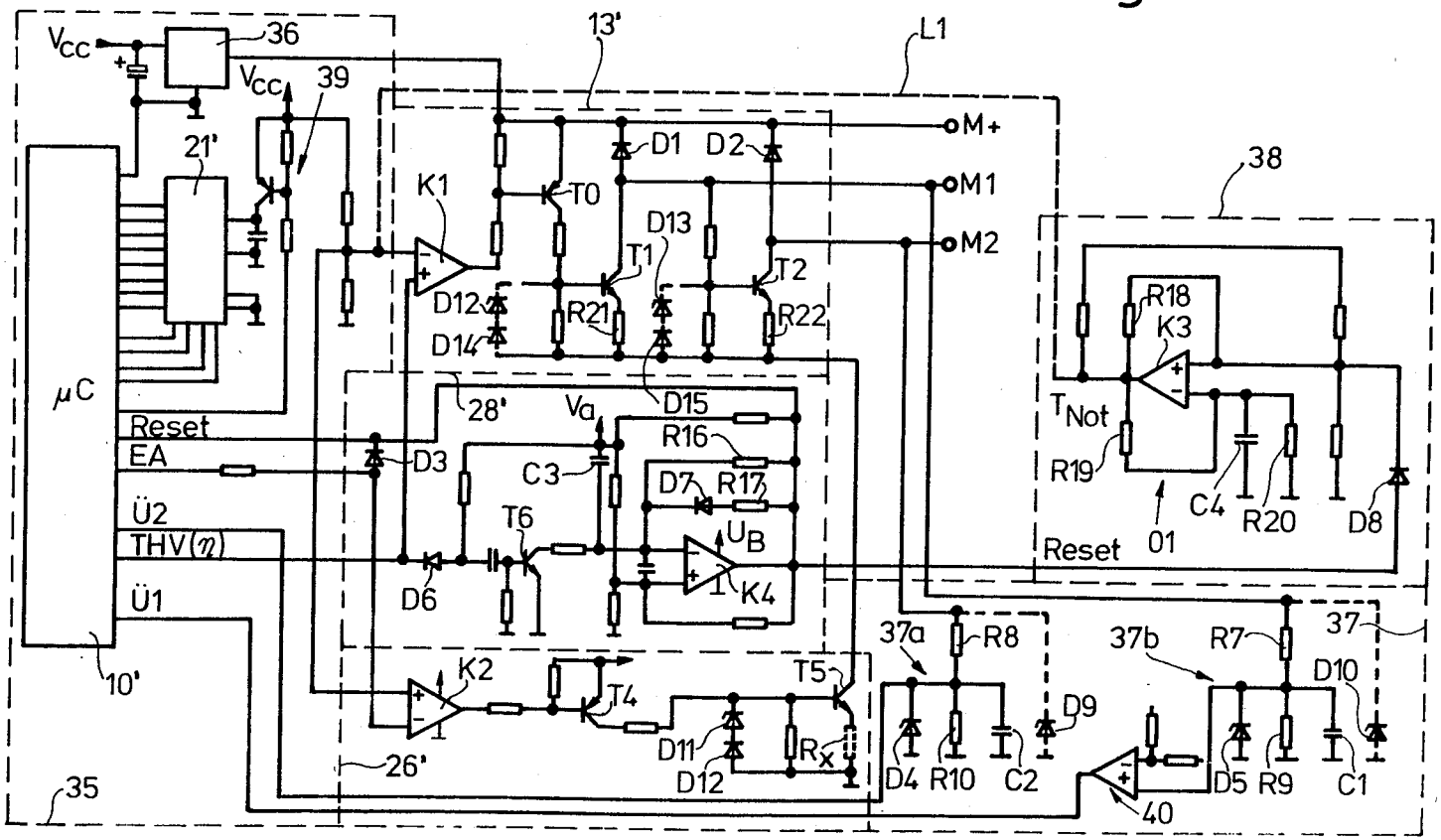
FIG. 5 is a further detailed exemplary embodiment having additional provisions.

The exemplary embodiment shown in FIG. 5 of a complete safety and emergency operation device having a multiplicity of optional embodiments has its individual component groups shown surrounded by dashed lines; components which are identical to and perform the same functions as those of the foregoing exemplary embodiments are identified by the same reference numerals, while comparable components are identified with the same reference numerals except that they are provided with a prime.

The circuit shown in FIG. 5 includes the block 35, containing the microprocessors, microcomputers, logical control and program circuits responsible for open- and closed-loop control of the system functions; it contains the microcomputer 10;, the data store 21' and a stabilizer circuit 36, the end stage 13', the block 26' for the shutoff of the end stage, a failsafe or safety circuit 28', a circuit 37 for preparation of the end stage monitoring signals U1 and U2, and an emergency operation circuit 38.

The emergency operation circuit 38 is merely provided as an option; if it is present, then the end stage shutoff 26' and perhaps also the preparation of the end stage monitoring signals by the circuit 37 can be dispensed with, as is in fact the case in the practical exemplary embodiment here.

A first provision differing from the exemplary embodiment shown in FIGS. 1 and 2 is that the failsafe circuit 28', which can also be called a watchdog circuit, is supplied now with the trigger signal pulses THV, acting as the control pulses, which are produced by the microcomputer 10. These trigger signal pulses THV contain the duty cycle $\eta$ corresponding to the bypass cross section required by the computer for a given operating state.

Parallel to this, the THV pulses travel via an additionally provided comparator K1 to the end stage 13', the other input of K1 being provided with a reference signal generated at 39.

The basic function here is as follows (the specialized design of the failsafe circuit 28' and of the emergency operation generator will be discussed in detail further below): Since the switching transistors T1 and T2 can function only in alternation, yet, as will readily be appreciated, for safety reasons only the "opening" of the two-coil rotary adjuster by the last transistor T2 to be triggered at a given time is critical, all the microcomputer 10' basically needs to be supplied with is the collector signal of the transistor T2, pulse-formed by the one pulse former stage 37*a* of the series resistor R8, followed by the parallel connection of the diode D4, the resistor R10 and the capacitor C2, this signal thus being in the form of the end stage monitoring signal U2.

The computer then calls up the duty cycle via U2 for correctness, both very shortly before and very shortly after each new emission of a duty cycle. If the computer ascertains that the duty cycles have deviated, then the computer itself sets the output EA (end stage shutoff to low, and the end stage switching transistors T1 and T2 are made current-free via the further additional comparator K2 and the transistors T4 and T5 already mentioned above. As a result, the two-coil rotary adjuster too, which is connected to the switching point M1, M2 and M+, is made current-free, and the spring pulls it back to the predetermined safety cross section, which with an operationally warm engine corresponds to an engine speed of approximately 1400 rpm, for instance.

What is important here is that the failsafe circuit is incorporated in the safety concept, with the purpose being that the failsafe circuit 28' for its part monitors the emission of the trigger signal pulse train THV by the computer and likewise, via the reset signal emitted by the failsafe circuit and via the diode D3, shuts off the end stage via K2, T4 and T5 whenever the failsafe pulses, i.e. the duty cycle pulses, of the computer are absent, for instance in the event of computer failure, or during starting, or the like.

The design and the function of the failsafe circuit are as follows. The THV trigger pulses from the computer travel via a diode D6 to a transistor T6, which charges a storage capacitor C3. The storage capacitor C3 is connected to an inverting input of a threshold value stage, which in a known manner is represented by a comparator K4. In a negative coupling branch leading to the inverting input, a resistor R16 and parallel to it the series circuit comprising a resistor R17 and a diode D7 are disposed. Thus, depending upon whether there is a logical low or high level at the output of the comparator K4, the storage capacitor C3 is either discharged or charged, whereupon the switching times and thus the duty cycle, which is contained in the reset signal emitted by the failsafe circuit 28', becomes freely adjustable within wide limits. Thus in this exemplary embodiment it is the failsafe circuit 28' which takes over if the THV trigger pulses of the microcomputer 10' are absent, which may represent a persistent computer failure, and acting as a rectangular oscillator the failsafe circuit 28' operates with a reset signal duty cycle of low, for instance 135 ms, and high, for instance 18 ms. The reset signal then, as explained earlier, travels to the microcomputer 10' for resetting and restarting purposes and travels via the diode D3 to the end stage shutoff 26', as a result of which, because of the high phases and the influence thereby exerted upon the emergency operation cross section at the two-coil rotary adjuster, it is possible to produce idling rpm changes upward or downward between 200 and 300 rpm.

The alternative embodiment having the emergency operation generator 38 includes a freely oscillating oscillator 01, embodied by a comparator K3, which is positively coupled via a resistor R18 and negatively coupled via a resistor R19; from the inverting input, a capacitor C4 is also connected to ground parallel to a further resistor R20. The emergency operation signal $T_{NOT}$ in this case, as indicated by the dashed connecting line L1, travels to the inverting input of the comparator K1 connected preceding the driver transistor T0; however, it can also trigger the end stage at some other location, for instance directly at the base of the driver transistor T0. The emergency operation generator 38 can be thrown ON by the reset signal of the failsafe circuit 28' via a diode D8, or instead it can oscillate continuously with a prespecified duty cycle such that during normal operation this duty cycle will lie within the range of the trigger pulse train THV duty cycle typically emitted by the microcomputer 10' and in that case will therefore not come into effect. If the end stage 13' is supplied with the emergency operation duty cycle by the generator 38, then neither the shutoff via the end stage shutoff 26' nor the feedback of the end stage monitoring signals U1, U2 to the microcomputer 10' is required; nevertheless, an advantageous embodiment of the invention may include both provisions, for if there should be a failure in the end stage shutoff 26', the emergency operation signal would then cause the position of the spool of the two-coil rotary adjuster to be within a non-critical range.

In a further embodiment of the present invention, interference suppressing Zener diodes D9, D10 are connected in parallel to the pulse former stages 37*a*, 37*b*, preceding the respective connecting resistors R8 and R7, that is, beginning with the switching points M1 and M2, respectively; it may furthermore be useful as well, with a view to the safety concept, to perform the generation of the end stage monitoring signals U1, U2 at high resistance such that comparators are incorporated in the two connecting lines leading back to the computer, as indicated at 40, as a result of which it is possible in the instance of shutoff to reduce the current decisively, at least in the ON coil of the two-coil rotary adjuster. A simple transistor stage is also useful here, if the semiconductors are integrated on an IC or hybrid.

A further embodiment encompasses the incorporation of an additional emitter resistor Rx from the emitter of the end stage shutoff longitudinal resistor T5 to ground and, parallel to the base-emitter resistor in this transistor the disposition of a Zener diode D11, perhaps in series with a further diode D11'. The result is an effective current limitation, which if based upon the duty cycle emitted by the computer will also prevent a short circuit of the rotary adjuster.

In a similar manner, the switching transistors T1 and T2 can, for the purpose of limiting the current, be equipped selectively with an additional emitter resistor R21, R22 and a limiting diode path parallel to the resistor connected from the base to ground, the diode path comprising either the series circuit of a Zener diode D12, D13 with a further diode D14, D15 or comprising only the Zener diode D12, D13.

Figure 6:
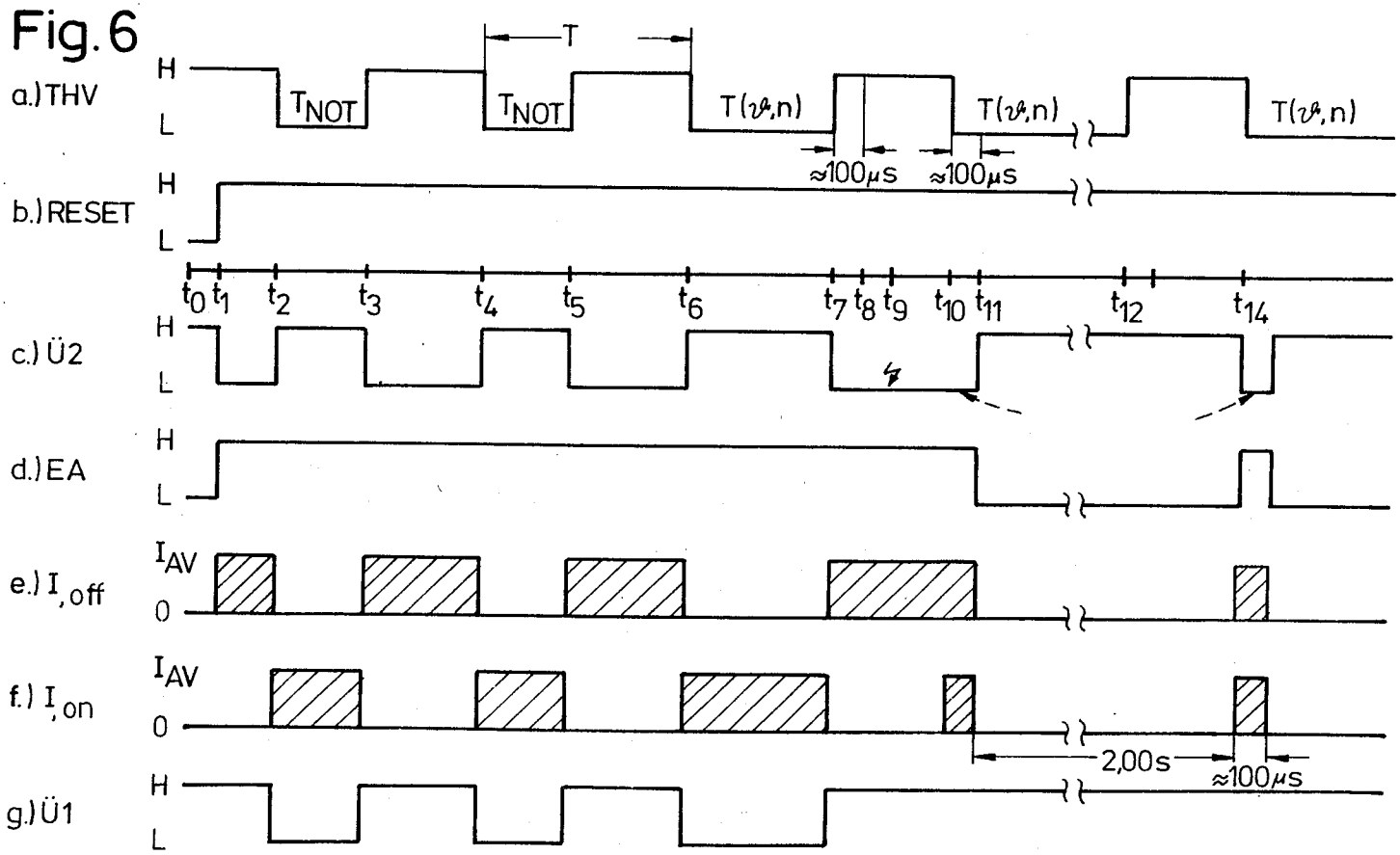
FIGS. 6*a*–6*g* show signal courses at various points of the circuit of FIG. 5.

The basic function of the circuit of FIG. 5 will now be explained, referring to the signal courses shown in FIG. 6.

The duty cycle trigger signal THV emitted by the computer 10' travels via the comparator K1 and the driver transistor T0 to the first switching transistor T1 of the end stage. Since the individual signal courses of FIG. 6 indicate the signal designations of the pulse trains, it is possible to understand the continuing course of the function by observing the signal pulse trains. At THV=low, the first transistor is conductive by the downwardly divided saturation voltage of the transistor T1, and the OPEN coil carries the nominal value of current.

At THV=high, the first switching transistor T1 is blocked; the OPEN coil, which is connected at the switching point M1, carries only the base current for the second switching transistor T2, which in an illustrated exemplary embodiment can amount to merely 1/22 of the coil current. The CLOSED coil carries the nominal current.

The opening cross section at the two-coil rotary adjuster is directly proportional to the ratio of the currents during the turn-on periods. The characteristic curve shift in the OPEN direction caused by the base current of the transistor T2 and which in addition is dependent on the duty cycle can be taken into account in designing the two-coil rotary adjuster. The output signal at the collector of the transistor T2 takes an inverted course to the THV trigger signal; as a result of the simply embodied pulse former stage 37*a*, the THV signal is limited and fed back, as the U2 end stage monitoring signal, to the microcomputer 10'. During an active reset phase (the reset signal is low), the end stage shutoff signal EA, which is emitted by the microcomputer 10', is bracketed to low by means of the direct linkage via the diode D3 with the output of the failsafe circuit 28', as a result of which the series transistor T5 to the end stage switching transistors is blocked via the comparator K2 and the driver transistor T4, and the coils of the two-coil rotary adjuster become correspondingly free of current. Only the signal former stage 37*a*, and 37*b* if present, then draw a current from the CLOSED or the OPEN coil, this current being still further reduced by means of comparators 40 selectively connected at the output side. The built-in spring establishes an emergency operation cross section at the two-coil rotary adjuster.

After the reset phase has elapsed at time $t_1$ and after the termination of the initialization routines up to time $t_2$, the microcomputer 10' begins first with the emission of an emergency operation duty cycle in accordance with its design, this being done until such time as the computer itself has evaluated the data it has received pertaining to engine speed, temperature and other parameters. This emergency operation duty cycle of the computer itself may have a duration of from one to two periods, and in the signal courses shown in FIG. 6 it extends up to time $t_6$, beyond which regulation is then established, beyond which time the pulse duration $T_{NOT}$ merges with the calculated function duration $T=f(\nu, n, \ldots)$.

After every THV pulse emission, for instance at time $t_7$, the computer makes a check after a predetermined time period of $t_8-t_7\approx 100\ \mu s$ has elapsed as to whether the U2 or U1 signal level agrees with the THV signal level. If there is some deviation, for instance a malfunction at time $t_9$ (the transistor T2 no longer blocks, the U2 signal does not go to high during the period $t_{10}\ldots t_{11}$), the computer finally, via its EA line (signal goes to low) and the comparator K2, shuts off the transistor T5 and makes the adjuster free of current.

An end stage monitoring routine in the microcomputer 10' then continues to check, after a prespecified time has elapsed, whether the malfunction still pertains; this time may be every 2 seconds, by way of example, and the check is performed by switching on the EA line and correspondingly calling up the U2 feedback line after a prespecified time, for instance 100 $\mu s$ (this is approximately five times the duration of the transistor switching times including filtering). Any influence on the adjuster current caused by this brief call-up does not produce a substantial change in the emergency operation cross section at the two-coil rotary adjuster established by the spring.

On the other hand if there are persistent computer malfunctions, then the failsafe circuit 28' takes over, acting as a rectangular, freely oscillating oscillator, as already mentioned. With its reset signal, it acts upon microcomputer 10', in order to reset it as needed and be able to throw it back ON. The reset phases likewise exert only a slight influence on the emergency operation cross section at the adjuster.

After the shutoff of the end stage via the EA signal from the computer——at time $t_{11}$——the U2 signal (and furthermore the U1 signal as well) must resume a high level. Should this not be the case, for instance in the event of an external short circuit to ground, then the end stage remains persistently shut off because of the selected computer programming. For example, approximately 2 seconds after time t11, the computer again emits a THV pulse, specifically from time t12 to time t14. Since the computer has noticed that the error (time t9) has been recognized after time t10, i.e., after a high-low edge of a THV signal, the computer does not switch the end stage back on again, with the aid of the EA signal, until the instant of the high-low edge of the present THV signal, that is, at time t14. If the error is still present, then the end stage is shut off again, via the EA signal. This entire operation can be repeated, for instance periodically.

The monitoring of the end stage output signals of both switching transistors has already been described above in connection with the exemplary embodiment of FIG. 2; as a result of this monitoring, coil short circuits or persistent short circuits are generally taken care of and in the case of malfunction (incorrect U1 or U2 signal) the procedure is then performed in analog fashion, as already described.

The following safety functions are accordingly attained in accordance with the present invention:

1. Reset of the operation;
2. Program monitoring;
3. Monitoring of the duty cycle trigger signal for the end stage;
4. Recognition of internal and external malfunctions;
5. Recognition of persistent malfunctions;
6. Recognition of battery voltage interventions;
7. Control of an emergency operation generator which may be included;
8. Shutoff of the end stage;
9. Shutoff of the computer port.

If an emergency operation generator is included:

1. In the reset instance, switching is performed actively;
2. Emission of an emergency operation duty cycle trigger signal.

Finally, given an appropriate embodiment and feeding of data to the microcomputer (10, 10'), the present invention also encompasses the following safety features:

1. Emergency operation duty cycle trigger pulse train, emitted by the computer itself until the first rpm recognition;
2. Emission of a value $t_{min}$ ($\nu$) if the temperature transducer fails;

3. Recognition of an NTC interruption;
4. Self-test program for shutting off the end stage in case of program errors or malfunctions (reset);
5. Test routine for checking the end stage, monitoring and shutoff;
6. Shutoff of the end stage in case of malfunction.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A failsafe emergency operation device for the digital idling charge regulation of motor vehicles, comprising an air bypass means parallel to the throttle valve of the engine of said motor vehicle, a final control element for controlling the flow of air through said air bypass, an end-stage circuit means having at least one output for triggering said final control element, a mechanical pre-stressed element connected to said final control element, a computer processing means for supplying the idling charge regulation with a digital trigger signal to said end stage having a variable duty cycle dependent upon said final control element position within said bypass, said processing means being programmed to monitor the clocked signal at said at least one output of said end stage circuit means to thereby shut off said end stage circuit means in response to deviations in said trigger signal, whereby said mechanical pre-stressed element produces an emergency operation at said final control element.

2. An emergency operation device as defined by claim 1, further comprising a failsafe circuit supplied with failsafe pulses separately generated by said computer processing means, said failsafe circuit generating a reset signal for delivering to a reset input of said computer processing means as well as indirectly to said end stage circuit means for shutting off said end stage.

3. An emergency operation device as defined by claim 2, wherein said reset output signal of said failsafe circuit and a shutoff signal from said computer processing means are supplied to a shutoff stage for said end stage via an OR element.

4. An emergency operation device as defined by claim 2, wherein in the event of persistent computer malfunctions, said circuit functions as a rectangular oscillator with a sharply reduced duty cycle, such that any influence on the spring-prestressed emergency operation of the final control element remains slight.

5. An emergency device as defined by claim 1, further comprising a failsafe circuit supplied with failsafe pulses separately generated by said computer processing means directly with said trigger signals for said end stage circuit means, said failsafe circuit generating a reset signal for delivering to a reset input of said computer processing means as well as indirectly to said end stage circuit means for shutting off said end stage.

6. An emergency operation device as defined by claim 5, wherein in the event of persistent computer malfunctions, said failsafe circuit functions as a rectangular oscillator with a sharply reduced duty cycle, such that any influence on the spring-prestressed emergency operation of the final control element remains slight.

7. An emergency operation device as defined by claim 5, wherein said reset output signal of said failsafe circuit and a shutoff signal from said computer processing means are supplied to a shutoff stage for said end stage via an OR element.

8. An emergency operation device as defined by claim 1, wherein said computer processing means has inputs for signals corresponding to rpm, engine temperature $\nu$, ambient temperature, pressure, aspirated air quantity and also has a data store, for the compensation of nonlinearities of the data supplied to said computer means for determining said final control element position.

9. An emergency operation device as defined by claim 1, wherein said end stage has two switching transistors connected one after the other and each acting upon one coil portion of said final control element, said transistors being triggered via a preceding driver transistor and if needed via a further, preceding comparator by said duty cycle trigger signal, whereby said switching transistors deliver a nominal current to said end stage, each respectively in alternation to its associated coil portions.

10. An emergency operation device as defined by claim 9, wherein current limiting resistors are disposed in the emitter lines of said switching transistors of said end stage, preferably together with respective diode series circuits connected parallel to a base leakage resistor of each of said switching transistors.

11. An emergency operation device as defined by claim 9, wherein an end stage shutoff stage is provided, having at least one longitudinal transistor in series with the joined switching paths of said switching transistors, wherein said longitudinal transistor is supplied with a shutoff signal from said computer processing means via a further pre-stage transistor and said reset signal of said failsafe circuit is supplied to a base voltage divider directly via a diode of said longitudinal transistor.

12. An emergency operation device as defined by claim 11, wherein for the purpose of current limitation, in the event for instance of a final control element short circuit, an additional current-limiting resistor is connected in series with said shutoff transistor of said end stage shutoff, preferably being connected in combination with the parallel circuit of a Zener Diode in series with a further diode parallel to the base leakage resistor for said shutoff transistor.

13. An emergency operation device as defined by claim 11, wherein feedback signals corresponding to said trigger duty cycle are derived from at least one of said coil portions connected with the associated collectors of said respective switching transistor of said end stage via pulse former stages and are supplied to corresponding test connections of said computer processing means, which upon a deviation from the duty cycle emits said shutoff signal and delivers it to said shutoff stage of said end stage.

14. An emergency operation device as defined by claim 13, wherein for the purpose of high-resistance and therefore current-reducing generation of said end stage monitoring signals switching means are disposed between said pulse former stages and the corresponding inputs at said computer processing means.

15. An emergency operation device as defined by claim 13, wherein shortly before and shortly after each new emission of a duty cycle said computer processing means is programmed to call up the duty cycle of said fed-back end stage monitoring signals and if deviations are ascertained then in the event of a malfunction causes said final control element to be current-free via an end stage shutoff signal going to a low level.

16. An emergency operation device as defined by claim 15, wherein in said at least one output of said end stage for at least one of said end stage monitoring signals, interference suppressing Zener diodes connected to ground are provided.

17. A failsafe emergency operation device for the digital idling charge regulation of motor vehicles, comprising an air bypass means parallel to the throttle valve of the engine of said motor vehicle, a final control element for controlling the flow of air through said air bypass, an end stage circuit means for triggering said final control element, a computer processing means for supplying the idling charge regulation with a digital trigger signal to said end stage having a variable duty cycle dependent upon said final control element position in said air bypass, a failsafe circuit means, said computer processing means supplying separate failsafe pulses to said failsafe circuit means, said failsafe circuit means generating a reset signal to said computer processing means, and an emergency operation generator means for receiving as well said reset signal for generating an emergency operation trigger signal having a constant duty cycle for said end stage circuit means.

18. A failsafe emergency operation device for the digital idling charge regulation of motor vehicles, comprising an air bypass means parallel to the throttle valve of the engine of said motor vehicle, a final control element for controlling the flow of air through said air bypass, an end stage circuit means for triggering said final control element, a computer processing means for supplying the idling charge regulation with a digital trigger signal to said end stage having a variable duty cycle dependent upon said final control element position in said air bypass, a failsafe circuit means, said trigger signal being supplied to said failsafe circuit directly with a prespecified duty cycle, said failsafe circuit means generating a reset signal to said computer processing means, and an emergency operation generator means for receiving as well said reset signal for generating an emergency operation trigger signal having a constant duty cycle for said end stage circuit means.

19. An emergency operation device as defined by claim 18, wherein at least for the delivery of a battery voltage and engine temperature signals to said computer processing means converter means are provided for converting corresponding voltage signals into logic-compatible time duration signals evaluatable by said computer processing means.

20. An emergency operation device as defined by claim 19, wherein said converters include a comparator, to one input of which a reference signal and to the other input of which the output signal of an energy storage means charged via a longitudinal transistor by the voltage to be converted are supplied, and said computer processing means for call-up purposes prepares a call-up signal at a predetermined time for blocking said longitudinal transistor, and wherein the duration from the discharging of said storage capacitor until the voltage falls below the threshold voltage, at which time a comparator emits a switchover signal to said computer processing means, is evaluated as a standard for the converted voltage.

* * * * *